US007069759B2

(12) United States Patent
Shore et al.

(10) Patent No.: US 7,069,759 B2
(45) Date of Patent: Jul. 4, 2006

(54) BAR DELIVERY SYSTEM AND METHOD

(75) Inventors: T. Michael Shore, Princeton, MA (US); Matthew Palfreman, Charlton, MA (US)

(73) Assignee: Morgan Construction Company, Worcester, MA (US)

( * ) Notice: Subject to any disclaimer, the term of this patent is extended or adjusted under 35 U.S.C. 154(b) by 126 days.

(21) Appl. No.: 10/701,676

(22) Filed: Nov. 5, 2003

(65) Prior Publication Data

US 2005/0091818 A1 May 5, 2005

(51) Int. Cl.
*B21B 1/00* (2006.01)

(52) U.S. Cl. ..... 72/203; 72/201; 72/250

(58) Field of Classification Search ..... 72/201, 72/203, 227, 228, 230, 250, 366.2; 29/417
See application file for complete search history.

(56) References Cited

U.S. PATENT DOCUMENTS

| | | | | |
|---|---|---|---|---|
| 2,809,545 | A | | 10/1957 | Norlindh |
| 3,236,084 | A | | 2/1966 | Kato |
| 3,625,043 | A | | 12/1971 | Neumann et al. |
| 3,760,931 | A | | 9/1973 | Buchheit |
| 3,774,433 | A | | 11/1973 | Pauels |
| 3,831,929 | A | | 8/1974 | Hellmer |
| 3,951,021 | A | | 4/1976 | Easter |
| 4,176,535 | A | | 12/1979 | Elsner et al. |
| 4,250,729 | A | | 2/1981 | Berz |
| 4,307,594 | A | | 12/1981 | Steinbock |
| 4,363,394 | A | | 12/1982 | Kirchhoff |
| 4,528,834 | A | | 7/1985 | Aoyagi et al. |
| 4,554,813 | A | | 11/1985 | Feldmann et al. |
| 4,809,530 | A | * | 3/1989 | Wilson ..... 72/201 |
| 4,884,429 | A | | 12/1989 | Wilson |
| 5,040,440 | A | | 8/1991 | Harvey |
| 5,174,142 | A | | 12/1992 | Pong |
| 5,423,200 | A | | 6/1995 | Shore |
| 5,893,288 | A | | 4/1999 | Shore |

FOREIGN PATENT DOCUMENTS

| | | | |
|---|---|---|---|
| EP | 0 319 317 | | 12/1988 |
| EP | 0 319 317 | A2 | 12/1988 |
| EP | 0 319 317 | | 6/1989 |
| GB | 2118875 | * | 11/1983 |
| JP | 06279215 | | 11/1994 |
| TW | 267114 | | 5/1983 |
| TW | 267114 | | 9/1983 |

* cited by examiner

*Primary Examiner*—Ed Tolan
(74) *Attorney, Agent, or Firm*—Gauthier & Connors, LLP

(57) ABSTRACT

A method and system are disclosed for receiving a hot rolled bar product from a rolling mill, and for delivering the bar product to a cooling bed. A shear subdivides the bar product into bar segments and alternately directs the bar segments to one or the other of two downstream intermediate paths for continued travel thereon. A switch on each of said intermediate paths alternately directs bar segments traveling thereon to one or the other of two respective downstream delivery paths for continued travel thereon to the cooling bed. Decelerators slow the bar segments traveling along the delivery paths.

13 Claims, 4 Drawing Sheets

BAR DELIVERY SYSTEM AND METHOD

BACKGROUND OF THE INVENTION

1. Field of the Invention

This invention relates generally to continuous hot rolling bar mills, and is concerned in particular with a system and method for delivering the hot rolled products of such mills to a cooling bed.

2. Description of the Prior Art

In modern bar mills currently in operation, hot rolled bar products exit the last mill stand, and are subjected to cooling by being passed through one or more water boxes. The bar products are then subdivided into bar segments by a dividing shear, which includes a switching mechanism for alternately directing the bar segments to one or the other of two downstream delivery paths leading to the cooling bed. Pinch roll units, friction pads, or the like serve to decelerate the bar segments traveling along the delivery paths, with the result that the bar segments gradually slide to a halt before being laterally transferred onto the cooling bed.

Relatively high tonnage rates can be achieved with this type of arrangement when the mill is rolling larger product sizes, e.g., those having diameters above about 10.0 to 12.0 mm. These larger products have enough column strength to resist buckling as they are being pushed through the water boxes at relatively high mill delivery speeds on the order of 10 to 30 m/sec.

However, as product sizes decrease, so do their column strengths decrease, with the result that mill delivery speeds must be reduced in order to avoid buckling when pushing the smaller product sizes through the water boxes.

Thus, for example, a single strand mill rolling 8.0 mm rod for delivery to a laying head can operate at a delivery speed of 60 m/sec or greater, yielding a capacity of 85 tons/hour. However, a similar mill rolling 8.0 mm bar for delivery to a cooling bed must necessarily roll at a significantly reduced delivery speed of about 32 m/sec with a reduction in capacity to about 45 tons/hour. The reduced delivery speed for bar products is due in large part to the inability of conventional bar handling systems to bring faster moving products to a halt before they are transferred laterally onto the cooling bed.

An objective of the present invention is to increase the tonnage rate at which mills are able to roll bar products, in particular smaller product sizes, e.g., those having diameters smaller than about 12.0 mm.

A companion objective of the present invention is to raise the speed at which the smaller bar products are delivered from the mill, and to then decelerate such bar products before they are cooled in the water boxes prior to being delivered to the cooling bed.

SUMMARY OF THE INVENTION

In accordance with the present invention, hot rolled bar products are subdivided by a dividing shear into bar segments, and the bar segments are alternately directed to one or the other of two downstream intermediate paths. A switch on each intermediate path then alternately directs the bar segments to one or the other of two downstream delivery paths leading to the cooling bed. The bar segments traveling along the four delivery paths are decelerated, preferably in at least two stages. The first deceleration stage operates to slow the bar segments to an intermediate speed lower than the speed at which the bar products are delivered from the mill, and the second deceleration stage operates to further slow the bar segments to a lower speed suitable for delivery to the cooling bed. The bar segments are cooled between the first and second deceleration stages while they are traveling at the intermediate speed.

Figure 1:
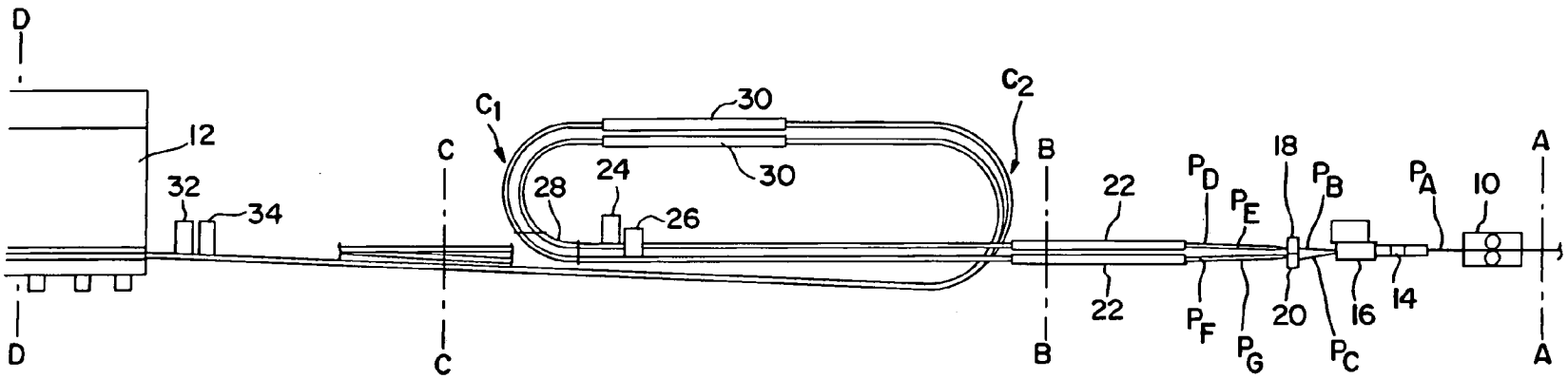
FIG. 1 is a plan view of a system in accordance with the present invention in a configuration suitable for handling smaller diameter higher speed bar products.

With reference initially to FIGS. 1 and 2A–C, a system in accordance with the present invention is shown between the last roll stand 10 of a continuous hot rolling bar mill and a conventional carryover cooling bed 12. Bar product exiting from roll stand 10 along path $P_A$ is passed through a series of water boxes 14, after which it is subdivided into bar segments by a dividing shear 16. The shear 16, which can be of a conventional design known to those skilled in the art, includes a switch mechanism which alternately directs the subdivided bar segments to one or the other of two downstream intermediate paths $P_B$, $P_C$. A switch 18 on intermediate path $P_B$ then serves to alternately direct the bar segments to one or the other of two downstream delivery paths $P_D$, $P_E$, and a switch 20 on intermediate path $P_C$ similarly directs product segments alternately to one or the other of two downstream delivery path $P_F$, $P_G$. The side-by-side sets of delivery paths $P_D$, $P_E$ and $P_F$, $P_G$ lead through a series of water boxes 22 to pinch roll units 24, 26, then around a side loop defined in part by two opposed 180° curves $C_1$, $C_2$. Curve $C_1$ is partially formed by a removable guide section 28. The side loop includes water boxes 30, and at curve $C_2$, the two sets of delivery paths $P_D$, $P_E$ and $P_F$, $P_G$ are brought into vertical alignment before continuing to pinch roll units 32, 34 preceding the cooling bed 12.

Figure 3:
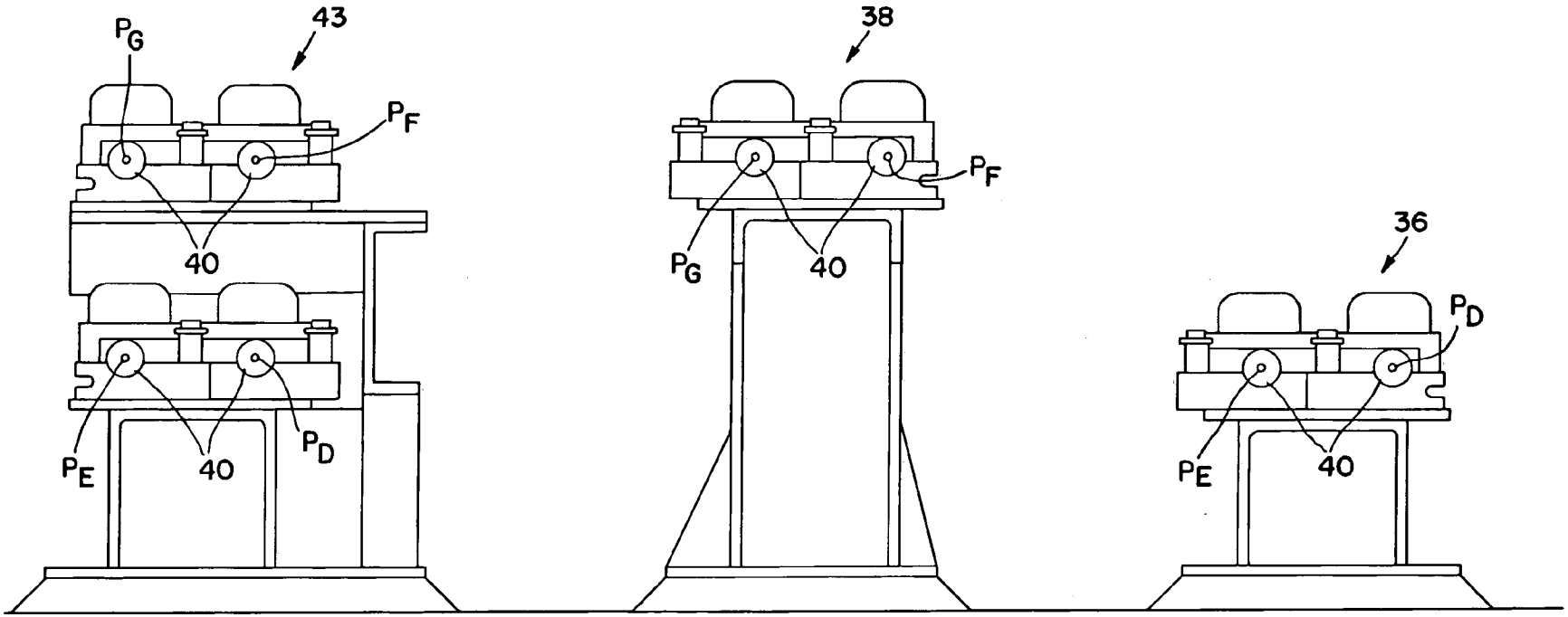
FIG. 3 is a sectional view on an enlarged scale taken along line 3—3 of FIG. 2B.

With reference to FIG. 3, it will be seen that single tier guide units 36, 38 with laterally spaced guide pipes 40 are employed to direct the bar segments along the laterally disposed and vertically offset sets of delivery paths $P_D$, $P_E$ and $P_F$, $P_G$, and two tier trough units 42 are employed to direct the bar segments when the two sets of delivery paths are aligned vertically.

Figure 5:
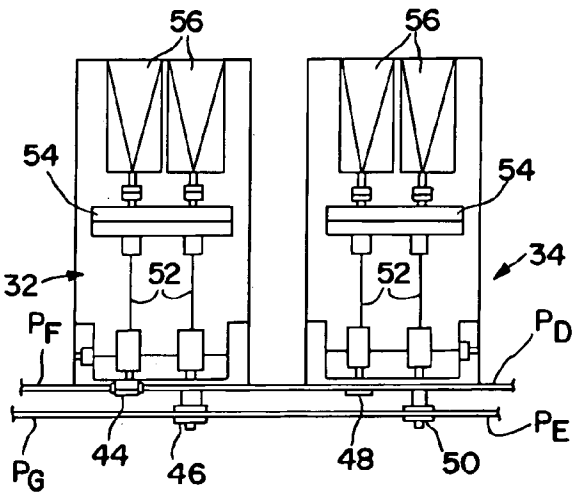
FIG. 5 is a partial plan and horizontal sectional view taken along line 5—5 of FIG. 4.
Figure 4:
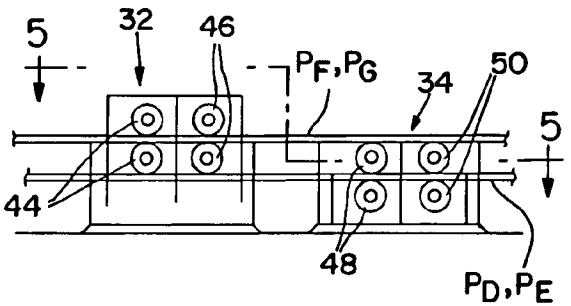
FIG. 4 is an enlarged front view of a pair of pinch roll units taken along line 4—4 of FIG. 2C.
Figure 2A:
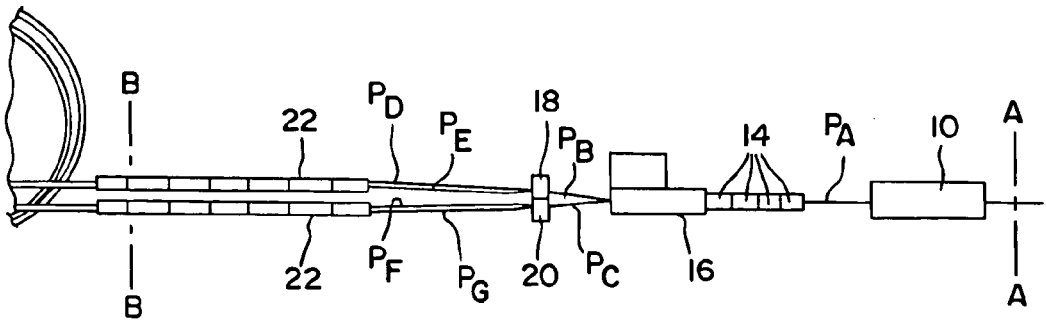
FIGS. 2A, 2B and 2C are enlarged views, respectively, of the areas between reference planes A–B, B–C, and C–D of FIG. 1.
Figure 2B:
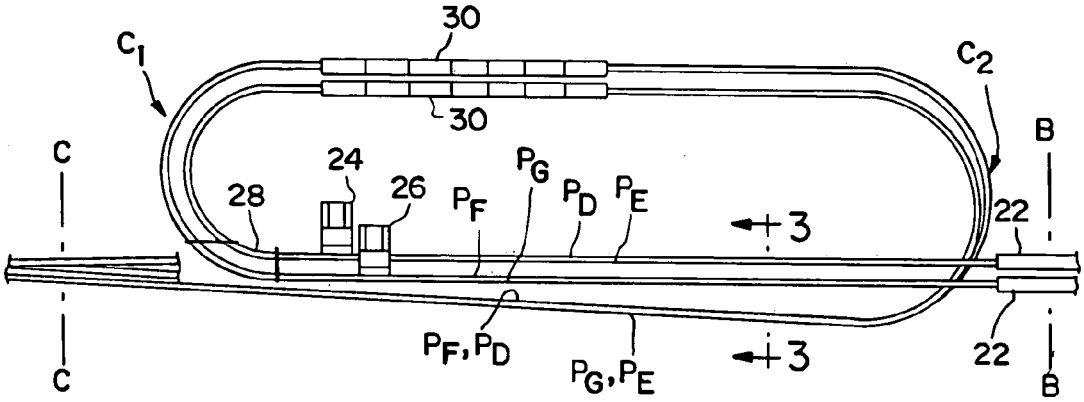
Figure 2C:
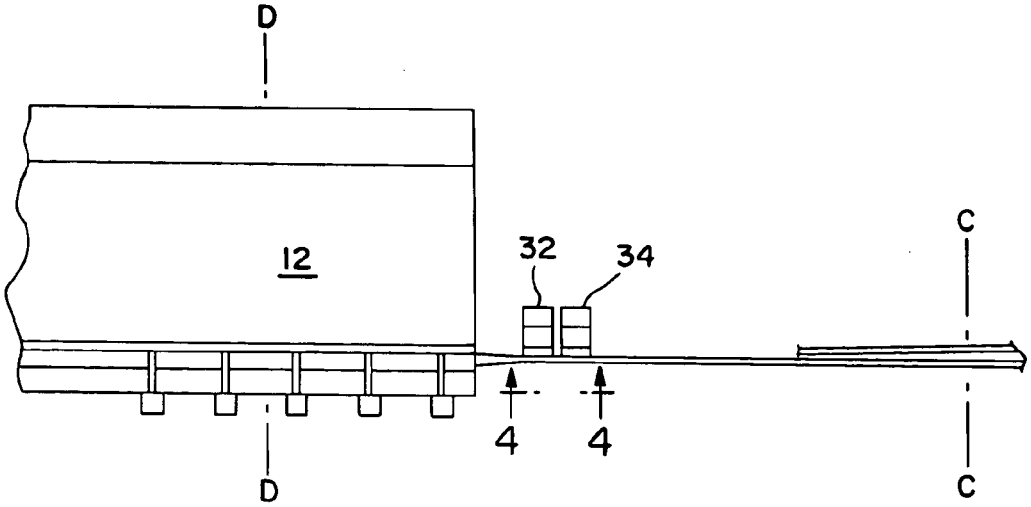

As can best be seen in FIGS. 4 and 5, pinch roll unit 32 has two sets of pinch rolls 44, 46 aligned respectively with delivery paths $P_G$ and $P_F$, and pinch roll unit 34 also has two sets of pinch rolls 48, 50 aligned respectively with delivery paths $P_D$ and $P_E$. Each set of pinch rolls is independently driven via drive shafts 52, a gear box 54 and drive motors 56. The pinch rolls are driven at speeds selected to effect an appropriate deceleration of bar segments frictionally gripped therebetween.

The pinch roll units 24, 26 are similarly constructed, but arranged slightly differently for alignment with the laterally disposed and vertically staggered guide paths.

An exemplary operation of the above-described system will now be further described with reference to the delivery to a cooling bed of a 8.0 mm diameter bar product exiting from the last roll stand 10 at a relatively high speed of 60 m/sec. and at a temperature of about 950–1050° C. The water boxes 14 are shut down, allowing the bar product to pass freely therethrough to the shear 16 where it is subdivided into successive bar segments. The switch mechanism of the shear alternately directs the bar segments to intermediate paths $P_B$, $P_C$. Bar segments traveling on path $P_B$ are then be alternately directed by switch 18 to delivery paths $P_D$, $P_E$, and bar segments traveling on intermediate path $P_C$ are likewise alternately directed by switch 20 to delivery paths $P_F$, $P_G$.

Pinch roll units 24 and 26 then operate to initially decelerate the bar segments to a lower intermediate speed of about 30 m/sec. The bar sections are directed by the curved guide section 28 around the side loop and through the water boxes 30. The linear distance between the pinch roll units 24, 26 and the water boxes 30 is preferably less than the length of the bar segments. Thus, the bar segments enter the water boxes 30 at a beneficially reduced speed and while they are still being acted upon by the pinch roll units 24, 26. The water boxes 30 operate to cool the bar segments down to about 500–600° C. before they negotiate curve $C_2$. The pinch roll units 32, 34 then operate to further decelerate the bar segments to a speed of about 3–8 m/sec., which will allow the bar segments to slide to a halt at the entry end of the cooling bed 12. From here, transfer mechanisms (not shown) operate to shift the bar segments laterally onto and across the cooling bed where they undergo further cooling before reaching the delivery side of the bed.

Of particular importance to the present invention is the provision of multiple delivery paths for the successive bar segments exiting from the dividing shear 16 coupled with multiple delivery paths for the products passing through the switches 18, 20. In the preceding example, successive bar segments would be subjected repeatedly to the following sequence:

| Intermediate Paths | Delivery Paths |
|---|---|
| $P_B$ | $P_D$ |
| $P_C$ | $P_F$ |
| $P_B$ | $P_E$ |
| $P_C$ | $P_G$ |

Only every fourth bar segment is directed to each delivery path, thus allowing ample time and space along each delivery path for one bar segment to begin decelerating before the next bar segment is received.

Figure 6:
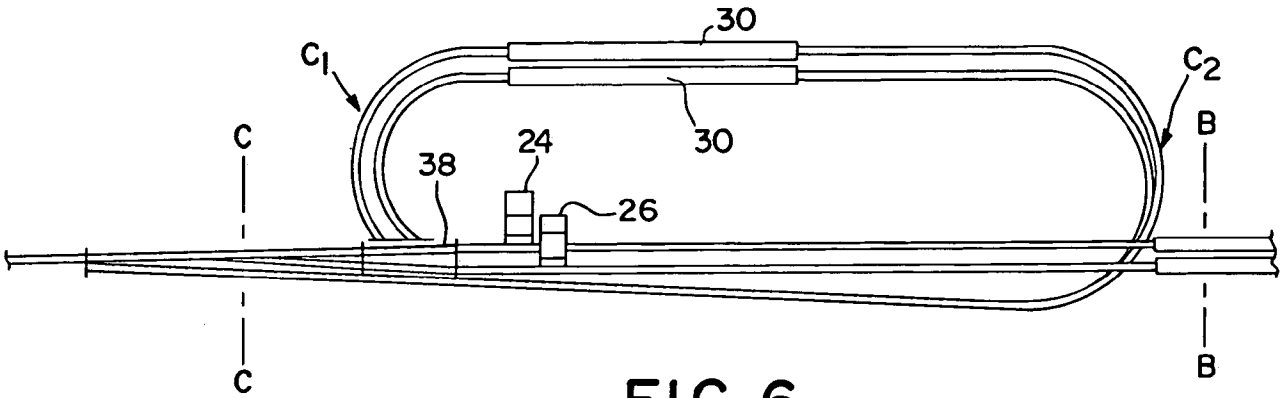
FIG. 6 is a view similar to FIG. 2B showing the system reconfigured to handle larger diameter slower moving bar products.

As shown in FIG. 6, when handling larger diameter slower bar products the system is reconfigured by replacing the curved guide section 28 with a straight tapering guide section 58. This bypasses the side loop formed between the 180° turns $C_1$ and $C_2$.

In this operational mode, the increased column strength of the larger diameter product and the slower delivery speed of the mill will allow cooling to take place in the water boxes 22. Two stage deceleration will then take place, initially by the pinch roll units 24, 26 and then by the pinch roll units 32, 34.

It will thus be seen that the system of the present invention is extremely flexible in that it can accommodate a wide range of products at beneficially high tonnage rates. Smaller diameter products, e.g., those ranging in diameter from 6.35 to 12.0 mm can be handled at relatively high mill delivery speeds on the order of 60 to 32 m/sec. by passing freely through the water boxes 22 and undergoing initial deceleration by pinch roll units 24, 26 before cooling is effected in water boxes 30. Larger diameter products exceeding 12.0 mm in diameter and exiting the mill at slower speeds below about 30 m/sec. can be cooled in the water boxes 22 before initial deceleration by pinch roll units 24, 26.

Figure 7:
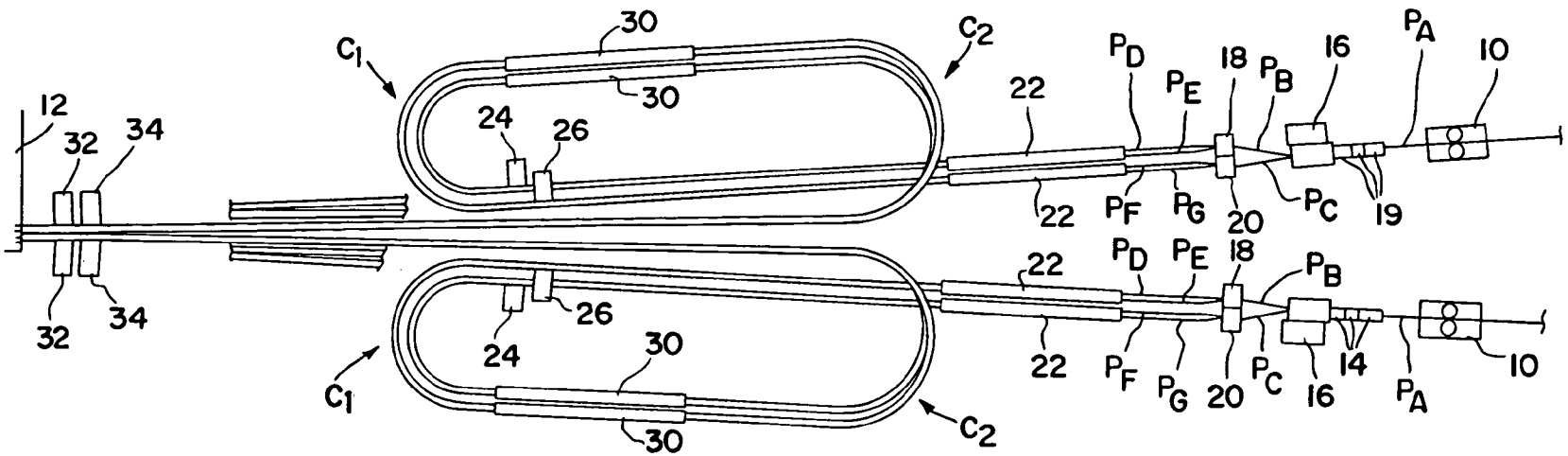
FIG. 7 is a plan view showing two of the systems depicted in FIG. 1 in a side-by-side mirror image arrangement.

As shown in FIG. 7, two systems of the type depicted in FIG. 1 can be arranged side by side to feed the same cooling bed.

We claim:

1. A system for receiving a hot rolled bar product from a rolling mill, and for delivering the bar product to a cooling bed, said system comprising:

shear means for subdividing the bar product into bar segments and for alternately directing the bar segments to one or the other of two downstream intermediate paths for continued travel thereon;

switch means on each of said intermediate paths for alternately directing bar segments traveling thereon to one or the other of two respective downstream delivery paths for continued travel thereon to said cooling bed; and decelerating means for slowing the bar segments traveling along said delivery paths, said decelerating means comprising first and second decelerators spaced one from the other along said delivery paths, said first decelerator being operable to slow the bar segments to an intermediate speed lower than the speed at which the bar product is delivered from said rolling mill, and said second decelerator being operable to further slow the bar segments from said intermediate speed to a lower speed suitable for delivery to said cooling bed, the distance between said first and second decelerators being greater than the length of said bar segments.

2. The system as claimed in claim 1 further comprising cooling means for cooling the bar segments traveling along said delivery paths.

3. The system as claimed in claim 2 wherein said cooling means comprises first and second cooling means spaced one from the other along said delivery paths, said first cooling means being located upstream of said first decelerator, and said second cooling means being located between said first and second decelerators.

4. The system as claimed in claim 3 wherein the distance between said first decelerator and said second cooling means is less than the length of the bar segments.

5. The system as claimed in claim 2 wherein said cooling means comprises water boxes for applying water to the bar segments.

6. The system as claimed in claim 1 wherein said decelerators comprise pinch roll units.

7. A system for receiving a hot rolled bar product from a rolling mill, and for delivering the bar product to a cooling bed, said apparatus comprising:

shear means for subdividing the bar product into bar segments and for alternately directing the bar segments to one or the other of two downstream intermediate paths for continued travel thereon;

switch means on each of said intermediate paths for alternately directing bar segments traveling thereon to one or the other of two respective downstream delivery paths for continued travel thereon to said cooling bed;

first and second decelerating means spaced one from the other along said delivery paths, said first decelerating means being operable to slow the bar segments to an intermediate speed lower than the speed at which the bar product is delivered from said rolling mill, and said second decelerating means being operable to further slow the bar segments from said intermediate speed to a lower speed suitable for delivery to said cooling bed; and first and second cooling means spaced one from the other along said delivery paths, said first cooling means being located upstream of said first decelerating means, and said second cooling means being located between said first and second decelerating means.

8. A method of receiving a hot rolled bar product from a rolling mill, and delivering the bar product to a cooling bed, said method comprising:

subdividing the bar product into bar segments and alternately directing the bar segments to one or the other of two intermediate paths for continued travel thereon;

alternately directing bar segments traveling along said intermediate paths to one or the other of two respective delivery paths for continued travel thereon to said cooling bed; and decelerating the bar segments traveling along said delivery paths in two stages, said first decelerating stage operating to slow the bar segments to an intermediate speed lower than the speed at which the bar product is delivered from said rolling mill, and said second decelerating stage operating to further slow the bar segments from said intermediate speed to a lower speed suitable for delivery to said cooling bed.

9. The method as claimed in claim 8 further comprising cooling the bar segments traveling along said delivery paths.

10. The method as claimed in claim 8 wherein the second decelerating stage occurs after the first decelerating stage has been completed.

11. The method as claimed in claim 10 further comprising cooling the bar segments traveling along said delivery paths.

12. The method as claimed in claim 11 wherein said cooling occurs while said bar segments are undergoing deceleration at said first stage.

13. A system for receiving a hot rolled bar product from a rolling mill, and for delivering the bar product to a cooling bed, said apparatus comprising:

shear means for subdividing the bar product into bar segments and for alternately directing the bar segments to one or the other of two downstream intermediate paths for continued travel thereon;

switch means on each of said intermediate paths for alternately directing bar segments traveling thereon to one or the other of two respective downstream delivery paths for continued travel thereon to said cooling bed;

first and second decelerating means spaced one from the other along said delivery paths, said first decelerating means being operable to slow the bar segments to an intermediate speed lower than the speed at which the bar product is delivered from said rolling mill, and said second decelerating means being operable to further slow the bar segments from said intermediate speed to a lower speed suitable for delivery to said cooling bed; and first and second cooling means spaced one from the other along said delivery paths, said first cooling means being located upstream of said first decelerating means, and said second cooling means being located between said first and second decelerating means, the distance between said first decelerating means and said second cooling means is less than the length of the bar segments.

* * * * *